United States Patent [19]

Kogan et al.

[11] 4,160,057

[45] Jul. 3, 1979

[54] SPLIT RESISTANT STRAPPING TAPE

[75] Inventors: Calvert S. Kogan, Westmount; Marty Kogan, Pointe Claire, both of Canada

[73] Assignee: Plastic Monofil Co. Ltd., Colchester, Vt.

[21] Appl. No.: 855,656

[22] Filed: Nov. 29, 1977

Related U.S. Application Data

[63] Continuation-in-part of Ser. No. 687,500, May 18, 1976, abandoned.

[30] Foreign Application Priority Data

May 21, 1975 [CA] Canada ..... 227402

[51] Int. Cl.[2] ..... D03D 15/00

[52] U.S. Cl. ..... 428/245; 139/420 R; 428/193; 428/265; 428/268

[58] Field of Search ..... 428/236, 245, 251, 252, 428/265, 268, 408, 902; 139/383 R, 420 R, 426 R; 206/83.5

[56] References Cited

U.S. PATENT DOCUMENTS

| | | | |
|---|---|---|---|
| 2,354,435 | 7/1944 | Stedman | 139/420 R |
| 2,619,705 | 12/1952 | Foster | 139/420 R |
| 2,788,023 | 4/1957 | Renaud | 139/420 R |
| 3,205,119 | 9/1965 | Paul | 139/426 R |
| 3,322,163 | 5/1967 | Hughes | 139/383 R |

*Primary Examiner*—James J. Bell

*Attorney, Agent, or Firm*—Beveridge, DeGrandi, Kline & Lunsford

[57] ABSTRACT

A strapping tape resistant to splitting has a width of about ⅛ inch to about 1½ inches, preferably about ¼ inch to about ¾ inch, about 22 to about 52 warp elements per inch, wherein each of said warp elements has a denier of about 840 to about 3000 and the total denier of all warp elements together does not exceed about 73,000/in. The strapping tape also comprises 1 to 5 weft elements per inch wherein each of the weft elements has a denier of about 50 to about 1000. The tape is particularly useful in the packaging and material handling art for baling, reinforcing and pallet securement.

21 Claims, 2 Drawing Figures

SPLIT RESISTANT STRAPPING TAPE

CROSS REFERENCE TO RELATED APPLICATION

This application is a continuation-in-part of application Ser. No. 687,500, filed May 18, 1976 now abandoned, the entire disclosure of which is relied upon.

BACKGROUND OF THE INVENTION

This invention relates to an improved split resistant strapping tape having low elongation and extremely strong strength primarily for use in the packaging of industrial and consumer products requiring high tensile strength, toughness and abrasion resistance to hold and tie objects, packages, cartons or combinations of these, to secure them to pallets, flat bed trailers or other shipping vehicles or uses utilizing baling or reinforcing strapping.

In addition to metal bands, many different types of strapping tapes are presently known. Such strapping tapes are generally formed from extruded polypropylene, polyesters, polyethylene and weftless tapes. In particular, weftless tapes have been known for many years and have been known to be used in the manufacture of ribbons or other tying materials.

The existing weftless tapes presently used in the above-mentioned applications have drawbacks when the product is applied under tension for there is a tendency for the tape to split. Splitting occurs due to the extremely low transversal strength that is inherent in weftless tapes. This is especially prevalent when the object being bound has an irregular shape. This drawback has been a factor of criticism in the packaging industry.

Over the years many new product innovations to the weftless cord tape strapping have been attempted; however, up until this time none have been successful.

SUMMARY OF THE INVENTION

This invention relates to improvements over weftless strapping tape by use of an uniquely different art in the manufacture of strapping tapes. More particularly, this invention provides a strapping tape resistant to splitting in a transverse direction. The tape of this invention has high tensile strength and a width of about ⅛ inch to about 1½ inches. The tape comprises about 22 to about 52 warp elements per inch. Each of the warp elements has a denier of about 840 to about 3000 and a total denier for all warp elements together up to about 73,000/in (e.g., 2600 denier×28 ends/in=72,800 denier/in.). The tape includes 1, 2, 3, 4 or 5 weft elements per inch, wherein each of the weft elements has a denier of about 50 to about 1000. Preferably, the warp elements have 2 to 300 ends per warp. An extremely low number of weft elements is provided by using fabric looms or other weaving mechanisms modified to provide extremely low picks of 1 to 5 picks per inch. The low number of picks makes it possible to manufacture strapping economically yet obtain the required resistance to splitting. The low number of picks assists in the manufacture of the tape as well as to prevent the warp yarns from splitting apart when used. In addition, the moderate degree of roughness produced by the yarn interlacing offers improved gripping power both in clamping and with the surface of the items being strapped.

BRIEF DESCRIPTION OF THE DRAWINGS

This invention is illustrated by way of example in the accompanying drawings wherein.

DETAILED DESCRIPTION

Figure 1:
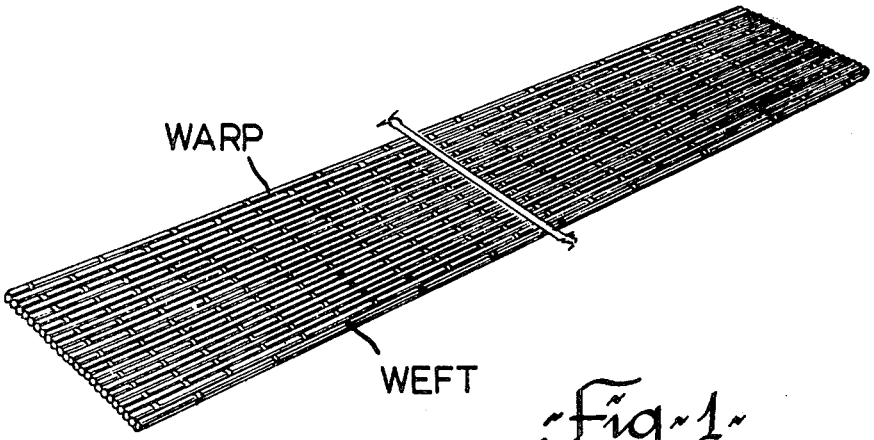
FIG. 1 is a perspective view of a portion of tape according to the invention.
Figure 2:
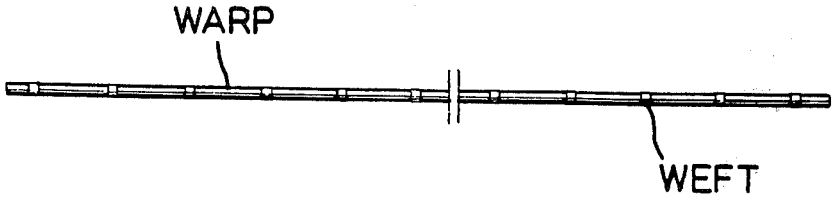
FIG. 2 is a side view of the tape shown in FIG. 1.

The strapping tape of this invention can generally be prepared on a narrow gauge loom by essentially standard weaving methods. The warp elements pass through a series of heddles mounted on harnesses, which can be controllably raised or lowered by the loom mechanism. By means of a predetermined sequence of raising and lowering of the harnesses, and with the coordinated systematic placement of the weft yarn and beat up of the reed, the desired strapping tape is obtained.

The strands can consist of either monofilament of multifilament single yarns or cords, or the strands can be produced by intertwisting two or more separate multifilament yarns to make a plied yarn. When cords of high denier yarns are employed as the strand units of the warp elements, the twist will preferably be below five turns per inch.

In the manufacture of weftless tape strapping it is extremely difficult, if not impossible, to manufacture these tapes from yarns with a zero twist. However, in our invention, a zero twist will produce an excellent strapping tape as the weft holds the individual warp strands together as well as holding the warp yarns in intimate contact with each other. Sometimes, however, there may be a tendency for the outermost warp of twistless yarn to bulge outward between picks. This is easily overcome by incorporating one or more warp yarns having twist, in the selvage edges of the woven tape. In so doing, economical twistless yarn can be used in the body of the tape without the tendency for bulging of the two outermost yarns.

The yarns are preferably made of man-made fibers, such as polyamide, polyester, polyolefin, rayon, polyacrylonitrile, fiberglass, etc., and are generally made to contain agents that protect the yarn from degradation by heat, ultraviolet light, oxidation and aging. Natural fiber yarns, such as cotton, jute, flax, paper, etc., as well as metallic yarns, such as the ferrous and non-ferrous metals, can also be used with this invention.

The warp elements are preferably about 26 to about 52 in number and have a denier preferably in the range of about 1300 to about 2600 denier and generally have a higher denier than the denier of the weft elements. The preferred denier of the weft elements is about 400 denier. The nature of the fibrous material employed for the weft elements in the practice of this invention is not usually critical, provided that the said fibrous material possesses adequate strength and durability to keep the warp ends together and prevent splitting. Suitable fibrous weft materials include cotton, rayon, wool and yarns of synthetic polymeric materials, such as those employed in the warp yarn. The warp and weft yarns may consist of spun yarns; however, it is preferable to use continuous multifilament or monofilament yarns in order to maximize strength and minimize manufacturing cost.

It should be noted that the strapping tapes within the scope of the invention can vary in their type weave in both single and multilayer construction with or without binder or stuffer yarns. For example, plain weave, twill, satin, basket, stripe broken and stripe pointed twills in single or multilayer construction and other weaves are satisfactory for use in our invention. In the manufacture of weftless strapping tapes of the prior art, individual strands of yarn must be placed together side by side in a longitudinal direction. As an example, for a ½" strap, 16 ends of 4000 denier are employed. In other words, to achieve the desired strength, four ends of 1000 denier can be twisted together and then multiplied by 16 ends to achieve the desired strapping.

In one embodiment of our invention, the individual longitudinal warp yarns can be consolidated into single warp elements by drawing, for example, 3 of them through the same heddle on the loom by utilizing 1000 denier instead of 3000 denier, achieving the desired strength and in many cases a greater strength than the weftless tape or the weftless strapping tape manufacturing process. Similarly, one can employ 2 strands of 1300 denier instead of a single strand of 2600 denier.

In another embodiment of this invention, there is provided a strapping tape fabric woven from monofilament yarns, strands or strips, which are pliable, non-splintering, tough, non-porous, have a high tensile strength and a high resistance to fatigue, abrasion and cutting.

In another embodiment of this invention, there is provided a comparative light weight strapping tape, the weave of which is formed from a multiplicity of longitudinal ends from monofilament yarns, strands or strips of extruded plastic material derived from the polymerization of vinylidene chloride, either alone or with one or more polymerizable vinyl compounds, in which the molecules of the plastic material are oriented along the axis of the yarns, strands or strips.

Another embodiment of our invention is to weave a broad woven fabric using the desired warp and filling yarns at the desired end and pick count and then slit the broad woven fabric using a hot knife, hot wire or other cutting apparatus, into strips of strapping tape having the desired width. While the body of the broad woven fabric may be of one weave, it would be preferable to selectively weave in leno or doup ends so that one or more doup or leno ends would occur in the selvage or edges of each strapping tape after cutting. The leno or doup woven yarns would prevent unravelling and assure maximum transversal strength and therefore be resistant to splitting.

Strapping tapes have been manufactured heretofore, but, while some of the desirable characteristics enumerated above have been obtained, none of the prior art structures or materials have achieved all the results or combinations and characteristics that are claimed herein, nor have they achieved the desirable results to the degree obtained with the tapes disclosed herein. As an example, in comparing our woven tape with a weftless tape, our tape has a transversal strength of 41.0 pounds per inch in comparison to 3.8 pounds per inch tansversal strength for the weftless tape. Therefore, the tape of our invention is 10 times stronger and more resistant to splitting than the weftless tape.

In the manufacture of weftless tape, individual strands are completely submersed in an adhesive bath. In our invention, on the other hand, our tape after the weaving process may be coated on the surface only using various adhesive application techniques. There is greater flexibility and speed, depending on the drying properties of the adhesive utilized.

There are many uses of this tape in various industries today. In certain applications, different types of flexibility or rigidity of the strapping tapes is required. Our invention also provides an extremely strong tape with a breaking strength from 50 to 25,000 pounds, or more if required. By applying special adhesives, such as polyurethane, epoxy, polyester, acrylic, polyvinyl alcohol, polyvinyl acetate, low melt polyethylene or any of the vegetable or animal type of adhesives or other adhesive, it is possible to provide either a flexible or a rigid tape depending on the manufacturing technique used.

This invention calls for the strapping tape to be easily tied in a knot when a flexible strapping is used and/or employing the regularly known techniques of utilizing buckles or seals generally used in the strapping industry today.

Many different types of weftless ribbons and tapes are known. These weftless tapes are generally formed from either natural fibers, for example, cotton, hemp, linen or silk, whereas the cord strappings are usually made out of rayon, nylon, polyester or polypropylene.

Canadian Pat. No. 544,703, issued Aug. 13, 1957, to Mr. Thomas J. Karrass, Montreal, Quebec, Canada, describes a weftless tape, which has certain limitations. This tape may be quite strong longitudinally, but it has certain limitations whereby it splits fairly easily which has been a common complaint in the packaging industry. As previously explained, our tape has excellent transversal strength, and therefore is resistant to splitting.

Another feature of our invention is the fact that the various numbers of ends are not necessarily manufactured longitudinally parallel to each other and may be placed one on top of each other through the needle loom, which will provide it with an extremely desirable feature in the use of our strapping tape in tied knot applications. Our manufacturing process provides the product with a greater resiliency and bulk in the longitudinal direction to provide a greater knot breaking strength at the knot to the breaking strength when not knotted.

Weftless tapes tend to be brittle or very weak at the knot and generally unsuitable for use in baling operations or when packages are placed under compression with outward tension and hand-tied with a knot. Therefore, weftless tape manufacturers generally recommend the use of buckles as the preferred method of application in holding the two ends of weftless tapes together.

In another embodiment of our invention, if it is desired to reduce tape elongation and eliminate slackening of the tape due to time dependent creep, in addition to using high modulus fibers, one can resort to hot stretching the individual yarns prior to weaving the tape or hot stretching the entire tape after weaving.

Another claim of our invention is that by utilizing a flat zero twist type of yarn a lesser number of ends are required. This is easily accomplished by using a yarn that has a breaking strength of eight to ten grams per denier or greater as compared to a lower quality type of polyester with a breaking strength of four to five grams per denier.

By virtue of its greater strength, fewer strands of continuous multifilament or monofilament are required to cover the same area without the sacrifice of strength.

It will be understood that the term "yarn" includes yarn produced from fibers from combination of drawing or drafting and twisting applied to prepared fiber masses, such as rovings, or the formation of yarn from filaments by the combination of cutting or breaking together with drafting and twisting.

The term "yarn" is understood to include continuous strands of fibers or filaments in a form suitable for weaving which may include a monofilament, a number of fibers twisted together, a number of filaments laid together without twist or a number of filaments laid together with more or less twist.

Modifications of this invention will be apparent to those skilled in the art and it is intended to cover all modifications and variations coming within the scope of the claims.

The terms of expression which have been employed are used as terms of description and not of limitation; there is no intention in the use of such terms and expressions of excluding any equivalents of the features shown and described or portions thereof, but it is recognized that various modifications are possible.

What is claimed is:

1. A strapping tape resistant to splitting in a transverse direction and having high strength, wherein said strapping tape has:

a width of about ⅛ inch to about 1½ inches, about 22 to about 52 warp elements per inch wherein each of said warp elements has a denier of about 840 to about 3000 and the total denier of all warp elements does not exceed about 73,000 denier/in, and 1 to 5 weft elements per inch wherein each of said weft elements has a denier of about 50 to about 1000.

2. Strapping tape according to claim 1 wherein said tape is about ¼ in. to about ¾ in. wide and said warp elements have a denier of about 1300 to about 2600.

3. Strapping tape according to claim 2 wherein said weft elements have a denier of about 400.

4. Strapping tape according to claim 2 having 4 weft elements per inch.

5. Strapping tape according to claim 2 having 5 weft elements per inch.

6. Strapping tape according to claim 2 wherein said tape is comprised of about 26 warp elements per inch, each element having a denier of about 2600.

7. Strapping tape according to claim 2 wherein said tape is comprised of about 52 warp elements per inch, each element having a denier of about 1300.

8. Strapping tape according to claim 1 in which said weft and warp elements are yarns having zero twist.

9. Strapping tape according to claim 1 in which said tape has at least one selvage edge containing one or more warp yarns having twist, and in which substantially all other warp and weft elements in said tape have substantially zero twist.

10. Strapping tape according to claim 1 in which said tape is comprised of monofilament yarns of extruded plastic derived from the polymerization of vinylidene chloride, wherein said yarn has a longitudinal axis and said plastic is comprised of molecules oriented along said axis.

11. Strapping tape according to claim 1 in which said tape has woven therein one or more doup or leno ends to prevent unravelling of said tape.

12. Strapping tape according to claim 1 wherein said tape is flexible and is coated with an adhesive selected from the group consisting of polyurethane, epoxy, polyester, acrylic, polyvinyl alcohol, polyvinyl acetate, low melt polyethylene, vegetable adhesive or animal adhesive.

13. Strapping tape according to claim 1 wherein said tape is comprised of yarns of high modulus fibers hot-stretched prior to incorporation in said tape to reduce elongation and time dependent creep of said tape.

14. Strapping tape according to claim 1 wherein said tape is hot-stretched to reduce elongation and time dependent creep of said tape.

15. Strapping tape according to claim 1 in which said tape is comprised of a flat, zero twist yarn having a breaking strength of at least 8 grams per denier.

16. Strapping tape according to claim 1 wherein said weft and warp elements are comprised of cotton, jute, flax, paper or metallic yarns.

17. Strapping tape according to claim 1 wherein said warp elements have a higher denier than the denier of said weft elements.

18. Strapping tape according to claim 1 wherein said tape has a breaking strength of 50 to 25,000 pounds.

19. Strapping tape according to claim 1 wherein the warp and weft elements are interlaced to provide roughness and gripping power during clamping and with the surface of an item being strapped.

20. A strapping tape resistant to splitting in a transverse direction and having high strength, wherein said strapping tape has:

a width of about ¼ inch to about ¾ inch, about 26 to about 52 warp elements per inch, wherein each of said warp elements has a denier of about 1300 to about 2600 and the total denier of all warp elements does not exceed about 73,000 denier/inch, 4 or 5 weft elements per inch wherein each of said weft elements has a denier of about 400, and a plain weave.

21. A strapping tape according to claim 20 wherein the warp and weft elements are interlaced to provide roughness and gripping power during clamping and with the surface of an item being strapped.

* * * * *

UNITED STATES PATENT AND TRADEMARK OFFICE

CERTIFICATE OF CORRECTION

PATENT NO. : 4,160,057

DATED : July 3, 1979

INVENTOR(S) : S. Calvert Kogan et al

It is certified that error appears in the above—identified patent and that said Letters Patent is hereby corrected as shown below:

On page 1, in the heading (Item 75), please correct the first inventor's name as follows:

S. Calvert Kogan (instead of Calvert S. Kogan).

Signed and Sealed this

*Fifteenth* Day of *June 1982*

[SEAL]

*Attest:*

GERALD J. MOSSINGHOFF

*Attesting Officer*

*Commissioner of Patents and Trademarks*